US008929802B2

(12) United States Patent
Yagi et al.

(10) Patent No.: US 8,929,802 B2
(45) Date of Patent: Jan. 6, 2015

(54) DISCHARGE DEVICE AND IMAGE-FORMING APPARATUS

(75) Inventors: Motoyuki Yagi, Yokohama (JP); Yukihiro Ichiki, Yokohama (JP)

(73) Assignee: Fuji Xerox Co., Ltd., Tokyo (JP)

( * ) Notice: Subject to any disclaimer, the term of this patent is extended or adjusted under 35 U.S.C. 154(b) by 161 days.

(21) Appl. No.: 13/169,675

(22) Filed: Jun. 27, 2011

(65) Prior Publication Data

US 2012/0099875 A1 Apr. 26, 2012

(30) Foreign Application Priority Data

Oct. 25, 2010 (JP) ..... 2010-238807

(51) Int. Cl.
*G03G 15/00* (2006.01)
*B65H 29/14* (2006.01)
*B65H 29/52* (2006.01)

(52) U.S. Cl.
CPC ..... *G03G 15/6573* (2013.01); *B65H 29/14* (2013.01); *B65H 29/52* (2013.01); *B65H 2404/14* (2013.01); *B65H 2553/612* (2013.01); *G03G 2215/00421* (2013.01)
USPC ..... 399/405; 399/406

(58) Field of Classification Search
CPC ..... G03G 15/6573; G03G 2215/00421
USPC ..... 399/405, 406, 400
See application file for complete search history.

(56) References Cited

U.S. PATENT DOCUMENTS

2009/0161135 A1* 6/2009 Chung et al. ..... 358/1.12
2009/0162121 A1* 6/2009 Kitan ..... 399/400
2009/0238618 A1* 9/2009 Kon et al. ..... 399/371

FOREIGN PATENT DOCUMENTS

JP 7-89660 A 4/1995
JP 2003-252509 A 9/2003
JP 2010208744 A * 9/2010

* cited by examiner

*Primary Examiner* — Matthew G Marini
*Assistant Examiner* — John M Royston
(74) *Attorney, Agent, or Firm* — Sughrue Mion, PLLC

(57) ABSTRACT

A discharge device includes a transport unit that transports a medium in the form of a sheet having a first surface and a second surface on the opposite side of the first surface; a contact member that comes into contact with the second surface of the medium transported by the transport unit, and that moves in a first direction in which the contact member presses the medium to a side of the first surface, and in a second direction opposite to the first direction within a predetermined range; a guide member provided so that the guide member does not come into contact with the contact member, that guides the medium transported by the transport unit while contacting the first surface of the medium, after the contact member comes into contact with the medium; and a discharge unit that discharges the medium guided by the guide member.

23 Claims, 4 Drawing Sheets

DISCHARGE DEVICE AND IMAGE-FORMING APPARATUS

CROSS-REFERENCE TO RELATED APPLICATIONS

This application is based on and claims priority under 35 USC 119 from Japanese Patent Application No. 2010-238807 filed on Oct. 25, 2010.

BACKGROUND

1. Technical Field

The present invention relates to a discharge device and an image-forming apparatus.

2. Related Art

An object in the form of a sheet may curl if it is heated. For example, in an electro-photographic image-forming apparatus, a sheet may curl in the fixing process, in which toner is fixed on the sheet by use of heat.

SUMMARY

An aspect of the present invention provides a discharge device including: a transport unit that transports a medium in the form of a sheet having a first surface and a second surface on the opposite side of the first surface; a contact member that comes into contact with the second surface of the medium transported by the transport unit, and that moves in a first direction in which the contact member presses the medium to a side of the first surface, and in a second direction opposite to the first direction within a predetermined range; a guide member provided so that the guide member does not come into contact with the contact member, that guides the medium transported by the transport unit while contacting the first surface of the medium, after the contact member comes into contact with the medium; and a discharge unit that discharges the medium guided by the guide member.

BRIEF DESCRIPTION OF THE DRAWINGS

Exemplary embodiments of the present invention will now be described in detail below with reference to the following figures, wherein.

DETAILED DESCRIPTION

Exemplary Embodiment

Figure 1:
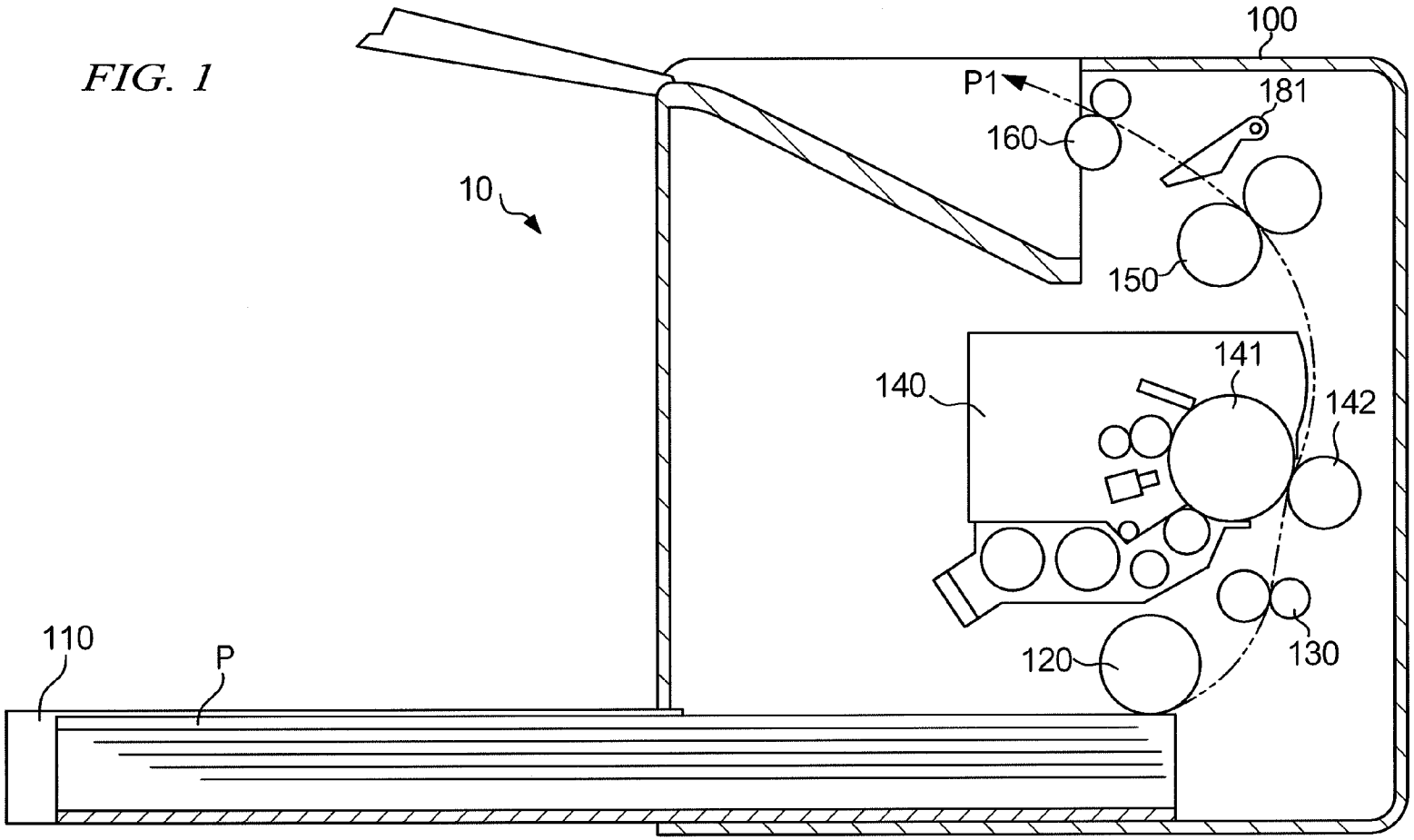
FIG. 1 is a schematic view of a configuration of an image-forming apparatus according to an exemplary embodiment.

FIG. 1 is a schematic view of a configuration of an image-forming apparatus according to an exemplary embodiment of the present invention. Image-forming apparatus 10 shown in FIG. 1 is a black-and-white electro-photographic printer, which includes housing 100, storage unit 110, supply roll 120, transport rolls 130, transfer unit 140, fixing unit 150, and discharge rolls 160. Also, image-forming apparatus 10 includes, in addition to the components shown in FIG. 1, control unit 200 and an obtaining unit for obtaining image data, which are described later. The obtaining unit is, for example, a unit for connecting to an external apparatus such as a personal computer, or a unit for retrieving image data from a detachable storage unit such as a memory card.

Storage unit 110 is a unit for storing sheets P. A sheet P is a recording medium onto which toner is transferred and fixed so that an image is recorded. Sheet P is an example of a medium according to the present invention. Supply roll 120 comes into contact with sheet P stored in storage unit 110, and discharges the sheet. Sheet P is transported along transport path P1 (two-dot chain line) shown in FIG. 1. It is to be noted that transport path P1 is a rough route; accordingly, the path is not necessarily identical to an actual transport path.

Transport rolls 130 are parts for transporting sheet P, which is supplied by supply roll 120. Transport rolls 130 transport sheet P at such timing that transfer unit 140 forms a toner image on sheet P. Transfer unit 140 is a unit for transferring toner onto sheet P, which has been transported by transport rolls 130. Transfer unit 140 includes photoreceptive body 141, a unit for forming a toner image on photoreceptive body 141 (a unit for carrying out processes of charging, exposing, and developing), and transfer roll 142 that transfers the toner image formed on photoreceptive body 141 to sheet P.

It is to be noted that in the following description, for convenience of explanation, a side of sheet P onto which a toner image is transferred will be referred to as "upper side" and the other side will be referred to as "underside." Namely, the upper side surface of sheet P is a surface that comes into contact with photoreceptive body 141, and the underside surface of sheet P is a surface that comes into contact with transfer roll 142. The upper side surface corresponds to a first surface according to the present invention, and the underside surface corresponds to a second surface according to the present invention. Also, in the following description, a size of sheet P in the transport direction will be referred to as "length," and a size of sheet P in a direction perpendicular to the transport direction (a direction perpendicular to the surface of a paper showing FIG. 1) will be referred to as "width." It is to be noted that either the length of sheet P or the width of the sheet may be greater.

Fixing unit 150 is a unit for carrying out a fixing process. Specifically, fixing unit 150 is a unit that fixes a toner image transferred onto sheet P by transfer unit 140, by heat and pressure. Fixing unit 150 transports sheet P, onto which a toner image has been transferred by transfer unit 140, while applying heat and pressure to the sheet. Discharge rolls 160 are parts for discharging sheet P to the outside of image-forming apparatus 10, which has been transported by fixing unit 150, which has been subjected to application of heat and pressure. Fixing unit 150 is an example of a transport unit according to the present invention, and discharge rolls 160 are examples of a discharge unit according to the present invention.

Figure 2:
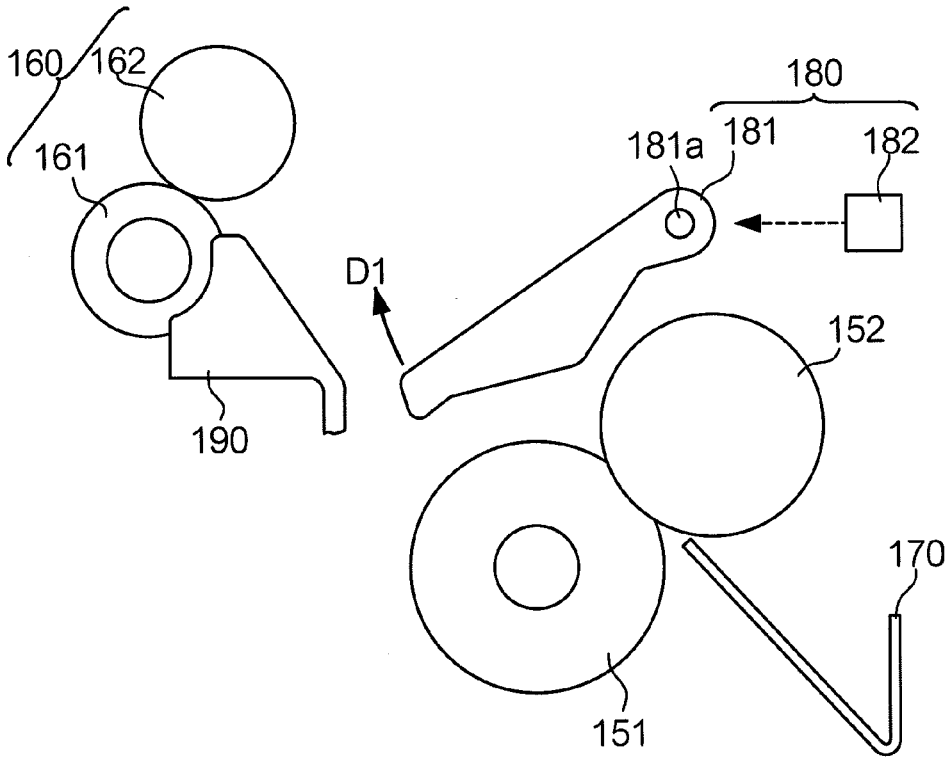
FIG. 2 is a diagram showing a detailed configuration of a fixing unit, discharge rolls, and components around them.

FIG. 2 is a diagram showing a detailed configuration of fixing unit 150, discharge rolls 160, and components around them. Image-forming apparatus 10 includes, in addition to the components shown in FIG. 1, guide member 170, detecting unit 180, and guide member 190. Fixing unit 150 includes heating member 151 and pressuring member 152, which are arranged so that they form a nip area. Discharge rolls 160 include first roll 161 and second roll 162, which are arranged so that they form a nip area. In the following description, the nip area formed by fixing unit 150 will be referred to as "fixing nip," and the nip area formed by discharge rolls 160 will be referred to as "discharge nip."

Heating member 151 is a roll-shaped member that includes a heat source such as a halogen lamp (halogen heater), and is driven to rotate by a driving unit (not shown). Heating member 151 comes into contact with the upper side of sheet P, and heats and transports the sheet to discharge rolls 160. On the other hand, pressuring member 152 comes into contact with the underside of sheet P, and is arranged so that a nip area (fixing nip) is formed between the pressuring member and heating member 151. Pressuring member 152 applies pressure to sheet P in the nip area by pressing the sheet against heating member 151. Pressuring member 152 may be in the form of a roller. Alternatively, pressuring member 152 may be formed by a cylindrical member with an outer padding for pressing the cylindrical member against heating member 151. It is to be noted that fixing unit 150 may have a configuration in which pressuring member 152, instead of heating member 151, may be rotated so as to transport sheet P.

Heating member 151 includes an elastic layer formed by a material such as a heat-resistant gum. The elastic layer of heating member 151 has elasticity such that the elastic layer is deformed when pressed by pressuring member 152 in the fixing nip, so as to fit the shape of pressuring member 152, and returns to the original shape after pressuring member 152 is moved away from heating member 151. Accordingly, the fixing nip has a shape such that pressuring member 152 fits into heating member 151. Heating member 151 is an example of a first roll member according to the present invention, and pressuring member 152 is an example of a second roll member according to the present invention.

Guide member 170 is a member that guides sheet P, which has been transported from transfer unit 140, to the fixing nip. A surface of guide member 170 that comes into contact with sheet P may be on a straight plane, or curved along transport path P1.

Detecting unit 180 is a unit for detecting sheet P. Specifically, detecting unit 180 is a unit for detecting a fact that sheet P exists between the fixing nip and the discharge nip. Detecting unit 180 includes contact member 181 and sensor 182. Detecting unit 180 is provided to detect an abnormality in transportation of sheet P.

Contact member 181 is a member arranged so that it comes into contact with sheet P at plural points. It is to be noted that contact member 181 does not necessarily contact the whole edge of sheet P in the width direction. Contact member 181 may contact only a part of the edge of sheet P in the width direction. Also, contact member 181 is provided so that it rotates around shaft 181*a* within a predetermined range. In the following description, a limit of the range in which contact member 181 moves will be referred to as "first position," and the other limit will be referred to as "second position." The position of contact member 181 shown in FIG. 2 is assumed to be a first position. Contact member 181 is able to move from the position shown in FIG. 2 in a direction indicated by arrow D1 shown in the same figure. In the following description, a moving direction in which contact member 181 moves from a first position to a second position will be referred to as "first direction," and a moving direction in which contact member 181 moves from a second position to a first position will be referred to as "second direction."

Contact member 181 is provided so that it is located at a first position by the effect of at least one of an urging member such as a spring and the weight of the member when the member is not in contact with sheet P. In a first position, contact member 181 is not in contact with fixing unit 150 or guide member 190. Also, the position of contact member 181 is arranged so that contact member 181 does not come into contact with guide member 190 when contact member 181 moves from a first position to a second position. Namely, contact member 181 is provided so that the member does not come into contact with guide member 190 at any position.

Sensor 182 is a unit for detecting a displacement of contact member 181 directly or indirectly. Sensor 182, for example, optically detects a fact that contact member 181 has moved from a first position to a second position. It is to be noted that sensor 182 may detect a displacement of contact member 181 by detecting a displacement of a member that moves together with contact member 181 (for example, a shutter that cuts light emitted from sensor 182). Also, sensor 182 may detect a displacement of contact member 181 using a method other than the optical method (for example, a contact with contact member 181 or a rotation angle of shaft 181*a*). It is to be noted that the position of sensor 182 may be arbitrarily determined as long as the sensor is able to detect a displacement of contact member 181. The position of sensor 182 is not limited to the position shown in FIG. 2.

Guide member 190 is a member provided so that it is located close to discharge rolls 160, that guides sheet P to the outside of image-forming apparatus 10. Guide member 190 guides sheet P that has been transported by fixing unit 150, to the discharge nip. Guide member 190 is formed by, for example, a resin material such as an ABS resin. Guide member 190 may be screwed to housing 100. Alternatively, guide member 190 and housing 100 may be formed as a single piece. If guide member 190, which is made of a resin material, is fixed to housing 100 using metallic screws, the screws having a heat conductivity higher than that of guide member 190, conduct heat emitted from heating member 151 more easily than guide member 190; therefore, the temperature of the screws by which guide member 190 is fixed to housing 100, is likely to increase.

Figure 3:
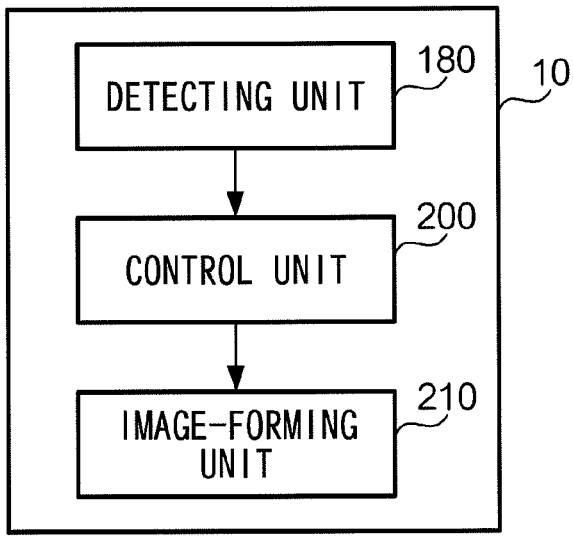
FIG. 3 is a block diagram showing a configuration relating to control of an image-forming apparatus.

FIG. 3 is a block diagram showing a configuration relating to control of image-forming apparatus 10. Image-forming apparatus 10 includes detecting unit 180, control unit 200, and image-forming unit 210. Image-forming unit 210 includes, in addition to supply roll 120, transport rolls 130, transfer unit 140, fixing unit 150, and discharge rolls 160, a unit for driving the components (for example, a motor). Control unit 200 is a unit for controlling operations of the components of image-forming apparatus 10. Control unit 200 includes an arithmetic device such as a CPU (Central Processing Unit) or an ASIC (Application Specific Integrated Circuit) and a memory. Detecting unit 180 provides a signal indicating a detection or no-detection of sheet P to control unit 200.

If a result of detection by detecting unit 180 does not satisfy a predetermined condition, control unit 200 determines that an abnormality in transportation of sheet P has occurred. The predetermined condition is a condition in which it is considered that sheet P is being transported normally. For example, if detecting unit 180 does not detect sheet P at a predetermined time, or if detecting unit 180 continues to detect sheet P for a time longer than a predetermined time, control unit 200 determines that an abnormality in transportation of sheet P has occurred. The abnormality in transportation is, specifically, a situation that sheet P gets jammed in transport path P1, or a situation that sheet P remains at one position. If control unit 200 determines that an abnormality in transportation has occurred, the control unit suspends an operation of image-forming unit 210 (transportation of sheet P or power supply to the heat source). Control unit 200 is an example of a determining unit according to the present invention.

The foregoing is a description of a configuration of image-forming apparatus 10. Image-forming apparatus 10 having the configuration forms a toner image according to image data, transfers the toner image onto sheet P, and fixes the toner image onto sheet P by applying heat and pressure to the sheet, in order to form an image. In the process, sheet P curls due to the fixing process.

In the following description, with regard to the curling of sheet P, two terms "upward curl" and "downward curl" will be used. The upward curl means a curl in which sheet P curls so that the edges of sheet P curl towards each other on the upper side of sheet P. The downward curl means a curl in which sheet P curls so that the edges of sheet P curl towards each other on the underside of sheet P.

One of the factors for causing a sheet that has undergone the fixing process to curl is generally considered to be the difference in the rate of heat expansion and the rate of heat contraction between a sheet and toner. Toner including material such as resin has a rate of heat expansion and a rate of heat contraction that are higher than those of a sheet including material such as cellulose. Accordingly, in a sheet that has undergone the fixing process, toner contracts; as a result, the sheet curls up at a side on which toner has been transferred (in the present exemplary embodiment, the upper side surface). In image-forming apparatus 10 according to the present exemplary embodiment, since heating member 151 is deformed, the fixing nip has a shape that causes a sheet to have a downward curl. As a result, sheet P according to the present exemplary embodiment is subjected to a force in the fixing nip, which relaxes the upward curl resulting from heat contraction of toner (namely, a force that causes the sheet to have a downward curl).

Fixing unit 150 according to the present exemplary embodiment is configured to cause sheet P to have a downward curl by a force larger than a force that causes the sheet to have an upward curl, so that the sheet that has gone through the fixing nip does not curl up toward heating member 151. Accordingly, sheet P having a downward curl is discharged from the fixing nip.

Figure 4:
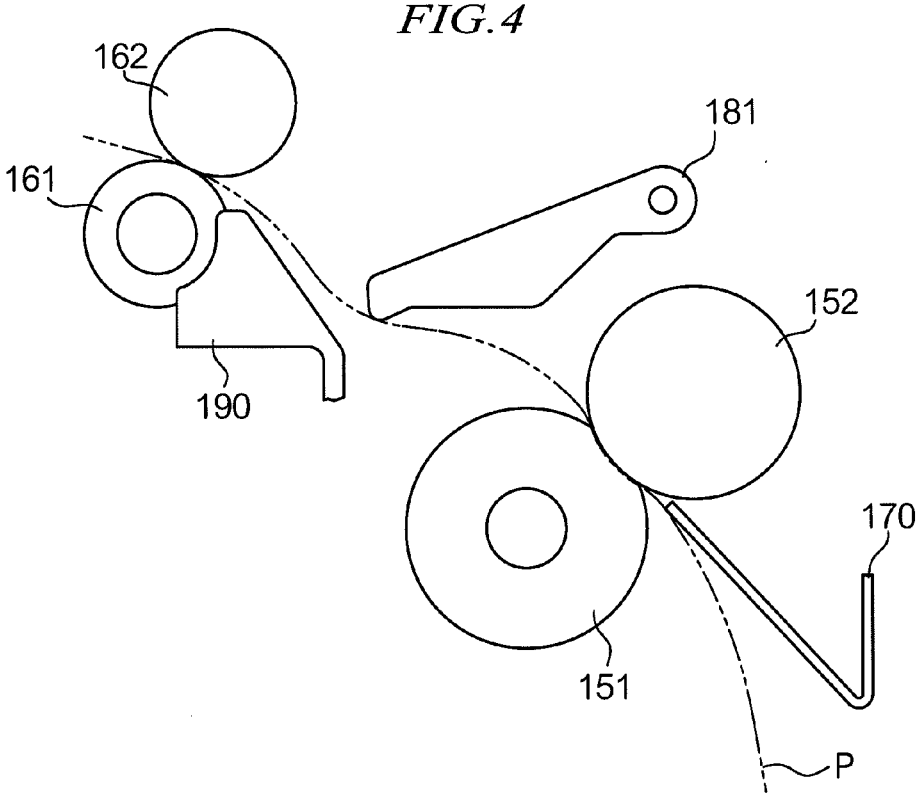
FIG. 4 is a diagram showing a curve of a sheet, which is to be discharged to the outside of an image-forming apparatus, the sheet having undergone the fixing process.

FIG. 4 is a diagram showing the curving of sheet P, which is in the process of being discharged to the outside of image-forming apparatus 10, after undergoing the fixing process. FIG. 4 shows the curving of sheet P when it is held in both the fixing nip and the discharge nip. To assume the curve shown in FIG. 4, sheet P initially comes into contact with contact member 181 before coming into contact with guide member 190. After sheet P comes into contact with contact member 181, sheet P then comes into contact with guide member 190, and thereafter it is transported to the discharge nip by fixing unit 150. In the process, contact member 181 moves in the second direction in accordance with a force in which sheet P is pressed against the member.

After sheet P reaches the discharge nip, the sheet is held between the fixing nip and the discharge nip so that the sheet is subjected to a tensional force. As a result, contact member 181 is held at the position shown in FIG. 4 (namely, a second position). As a result, sheet P is caused to have an upward curl by contact member 181 in the space extending from the fixing nip to a position contacting contact member 181. Namely, sheet P is caused to have a curl (upward curl) opposite to a curl (downward curl), of sheet P, which occurred immediately after going through the fixing nip, so that the downward curl is relaxed. Also, sheet P is caused to have a downward curl by contact member 181 in the space extending from a position of contacting contact member 181 to the discharge nip. To sum up, sheet P is caused to have a downward curl, an upward curl, and a downward curl after the sheet goes through the fixing process after which the sheet is discharged to the outside of the image-forming apparatus 10.

Figure 5:
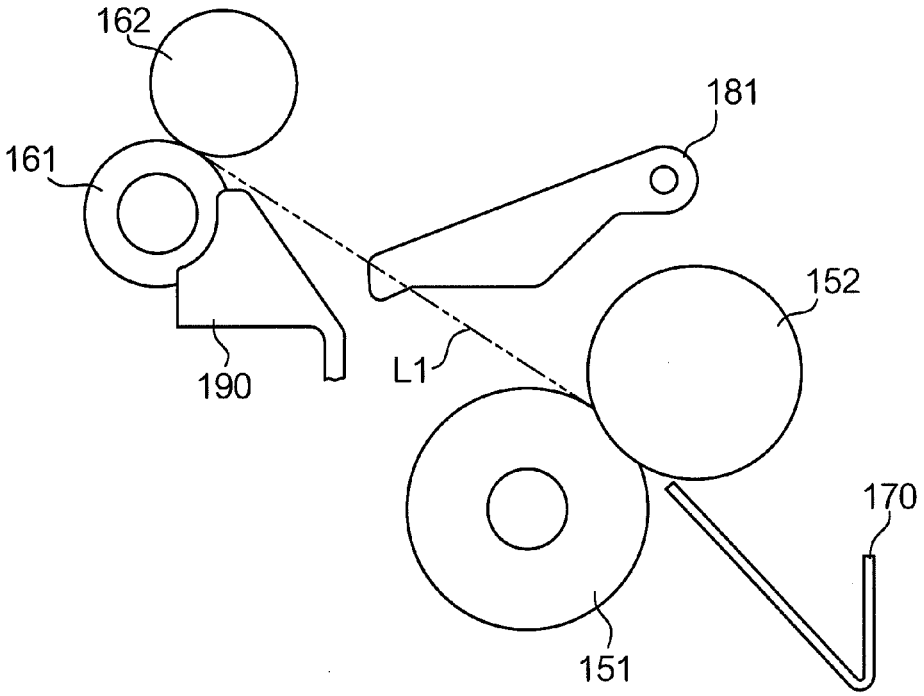
FIG. 5 is a diagram showing a positional relationship between a contact member located at a second position, a fixing nip, and a discharge nip.

FIG. 5 is a diagram showing a positional relationship between contact member 181 located at a second position, the fixing nip, and the discharge nip. In the drawing, line L1 is a line including the end point of the fixing nip and the start point of the discharge nip. When contact member 181 is positioned at a second position, the tip of the member (the part that comes into contact with sheet P in the condition shown in FIG. 4) is positioned at the side of guide member 190 relative to line L1, as shown in FIG. 5. By having such a positional relationship relative to the fixing nip and the discharge nip, contact member 181 has a larger force for causing sheet P to curl, which is held in the fixing nip and the discharge nip.

Figure 6:
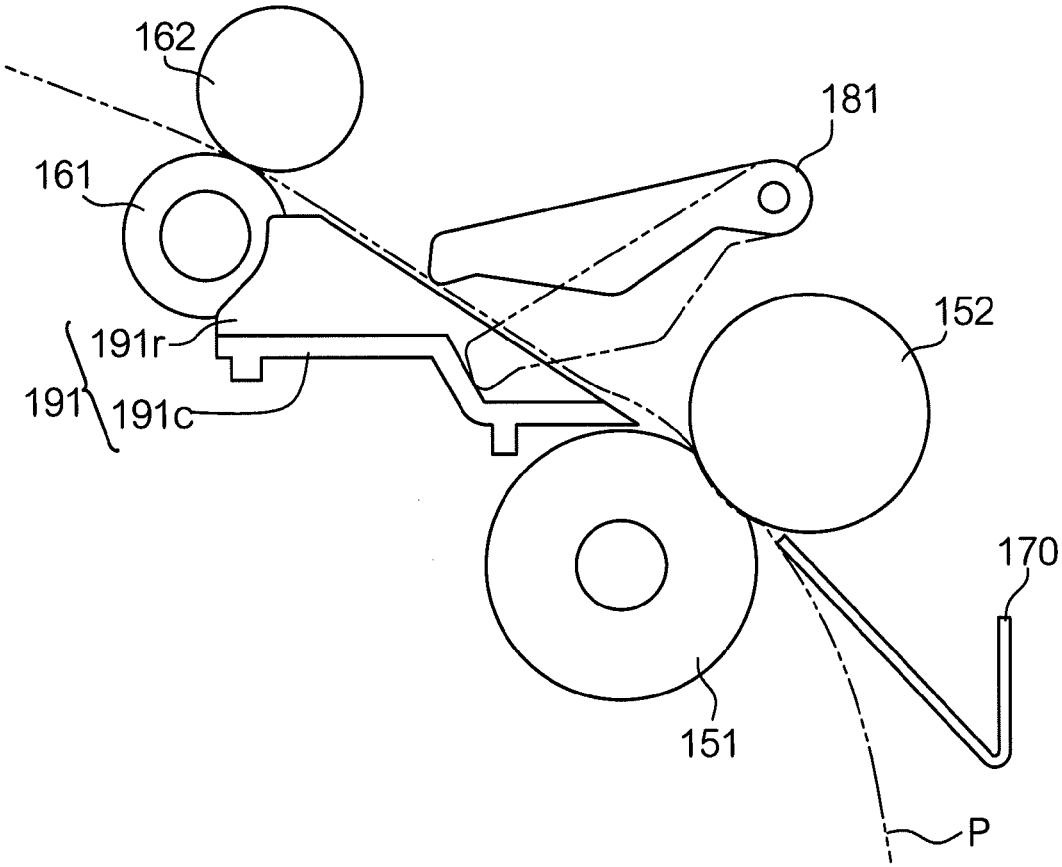
FIG. 6 is a diagram showing a comparative example relative to an exemplary embodiment.

FIG. 6 is a diagram showing a comparative example relative to the present exemplary embodiment. In the comparative example shown in the drawing, guide member 191 is provided, instead of guide member 190. Guide member 191 includes one or more ribs 191*r* that guide sheet P to the discharge nip, and contact portion 191*c* that comes into contact with contact member 181 at a position that opposes contact member 181. It is to be noted that contact portion 191*c* may be provided as a slit between plural ribs 191*r*. In the present comparative example, the position at which contact member 181 is in contact with contact portion 191*c* (the position indicated by the two-dot chain line in FIG. 6) is a first position for contact member 181.

Guide member 191 is provided so that it is located close to heating member 151 as compared with guide member 190. Accordingly, guide member 191 is subjected to more heat, and therefore, is likely to be deformed due to the heat, as compared with guide member 190. Also, guide member 191 is configured so that it comes into contact with sheet P being transported, at more points along the transportation direction, as compared with guide member 190. Namely, sheet P is transported while being sandwiched between contact member 181 and contact portion 191.

[Modifications]

An exemplary embodiment of the present invention is not limited to the exemplary embodiment described above. The present invention may be implemented in an exemplary embodiment described below.

An image-forming apparatus according to the present invention may have a configuration in which a component corresponding to a fixing device or discharge device is detachable. The fixing device is a device including components corresponding to at least fixing unit 150, contact member 181, guide member 190, and discharge rolls 160, which are described above. The discharge device is the fixing device not having a component corresponding to fixing unit 150.

In the fixing device according to the present invention, in a case where an image is formed on a surface of a sheet opposite the surface on which an image is formed in the above exemplary embodiment (in a case where an image is formed on the underside of the sheet according to the above exemplary embodiment), positions of heating member 151 and pressuring member 152 may be exchanged. In such a case, a sheet discharged from the fixing nip is to have the same curl as that of the above exemplary embodiment, even if the surface of pressuring member 152 is not configured to deform.

In the above exemplary embodiment, contact member 181 is a part of a unit for detecting sheet P, and is also a unit for relaxing a curl caused by fixing unit 150. However, a contact member according to the present invention does not necessarily have to be a part of the unit for detecting a sheet (medium). A contact member according to the present invention may be a member for performing only de-curling. A moving method of a contact member according to the present invention is not limited to rotational movement. The moving method may be a parallel displacement of a contact member.

A transfer unit according to the present invention may be a unit for transferring toner images of plural colors. Namely, an image-forming apparatus according to the present invention may be a color printer, instead of a black-and-white printer.

A medium used in the present invention is not limited to a piece of paper, or a sheet onto which toner is transferred. A medium may be arbitrarily determined as long as the medium is in the form of a sheet and is caused to curl due to heat.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to explain best the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A discharge device comprising:

a transport unit that transports a medium in the form of a sheet having a first surface and a second surface on the opposite side of the first surface;

a contact member that comes into contact with the second surface transported by the transport unit, and that moves to a first position in a first direction in which the contact member presses the medium to a side of the first surface, and to a second position in a second direction opposite to the first direction within a predetermined range;

a guide member provided so that the guide member does not come into contact with the contact member, that guides the medium transported by the transport unit while contacting the first surface, after the contact member comes into contact with the medium; and a discharge unit that discharges the medium guided by the guide member, wherein the medium is transported along a transport path and the guide member is positioned such that the guide member does not obstruct any portion of the transport path, wherein the guide member is positioned closer to the discharge unit than the contact member, the transport unit comprises a pair of roll members provided in opposition to each other forming a first nip area;

the discharge unit comprises a pair of roll members provided in opposition to each other forming a second nip area;

wherein a hypothetical line extends between an end point of the first nip area and a starting point of the second nip area; and wherein when the contact member is positioned at the second position, a tip of the contact member crosses over the hypothetical line and is disposed on the same side as the guide member relative to the hypothetical line.

2. The discharge device according to claim 1, wherein:

the transport unit comprises a pair of roll members that oppose each other so that the roll members form a nip area, comprising a first roll member that comes into contact with the first surface, and a second roll member that comes into contact with the second surface; and the first roll member is deformed in the nip area to fit a shape of the second roll member.

3. The discharge device according to claim 1, comprising:

a detecting unit that detects a displacement of the contact member; and a determining unit that determines that an abnormality in transportation of the medium has occurred if a result of a detection by the detecting unit does not satisfy a predetermined condition.

4. The discharge device according to claim 2, comprising:

a detecting unit that detects a displacement of the contact member; and a determining unit that determines that an abnormality in transportation of the medium has occurred if a result of a detection by the detecting unit does not satisfy a predetermined condition.

5. The discharge device according to claim 1, which is provided at a fixing device comprising a heating unit that heats a medium, and a pressuring unit that pressures the medium.

6. The discharge device according to claim 2, which is provided at a fixing device comprising a heating unit that heats a medium, and a pressuring unit that pressures the medium.

7. The discharge device according to claim 3, which is provided at a fixing device comprising a heating unit that heats a medium, and a pressuring unit that pressures the medium.

8. The discharge device according to claim 4, which is provided at a fixing device comprising a heating unit that heats a medium, and a pressuring unit that pressures the medium.

9. An image-forming apparatus comprising:

a transfer unit that transfers a toner image to a medium in the form of a sheet having a first surface and a second surface on the opposite side of the first surface;

the discharge device according to claim 5; and a fixing device comprising a heating unit that heats a medium, and a pressuring unit that pressures the medium.

10. An image-forming apparatus comprising:

a transfer unit that transfers a toner image to a medium in the form of a sheet having a first surface and a second surface on the opposite side of the first surface;

the discharge device according to claim 6; and a fixing device comprising a heating unit that heats a medium, and a pressuring unit that pressures the medium.

11. An image-forming apparatus comprising:

a transfer unit that transfers a toner image to a medium in the form of a sheet having a first surface and a second surface on the opposite side of the first surface;

the discharge device according to claim 7; and a fixing device comprising a heating unit that heats a medium, and a pressuring unit that pressures the medium.

12. An image-forming apparatus comprising:

a transfer unit that transfers a toner image to a medium in the form of a sheet having a first surface and a second surface on the opposite side of the first surface;

the discharge device according to claim 8; and a fixing device comprising a heating unit that heats a medium, and a pressuring unit that pressures the medium.

13. A discharge device comprising:

a transport unit that transports a medium in the form of a sheet having a first surface and a second surface on the opposite side of the first surface;

a contact member that comes into contact with the second surface transported by the transport unit, and that moves to a first position in a first direction in which the contact member presses the medium to a side of the first surface, and to a second position in a second direction opposite to the first direction within a predetermined range;

a guide member provided so that the guide member does not come into contact with the contact member, that guides the medium transported by the transport unit while contacting the first surface, after the contact member comes into contact with the medium; and a discharge unit that discharges the medium guided by the guide member, a housing, wherein the guide member is immovably fixed with respect to the housing, wherein the guide member is positioned closer to the discharge unit than the contact member;

the transport unit comprises a pair of roll members provided in opposition to each other forming a first nip area;

the discharge, unit comprises a pair of roll members provided in opposition to each other forming a second nip area;

wherein a hypothetical line extends between an end point of the first nip area and a starting point of the second nip area; and wherein when the contact member is positioned at the second position, a tip of the contact member crosses over the hypothetical line and is disposed on the same side as the guide member relative to the hypothetical line.

14. A discharge device comprising:

a transport means for transporting a medium in the form of a sheet having a first surface and a second surface on the opposite side of the first surface;

a contact means for coming into contact with the second surface transported by the transport means, and that moves to a first position in a first direction in which the contact means presses the medium to a side of the first surface, and to a second position in a second direction opposite to the first direction within a predetermined range;

a guide means provided so that the guide means does not come into contact with the contact means, for guiding the medium transported by the transport means while contacting the first surface, after the contact means comes into contact with the medium; and a discharge means for discharging the medium guided by the guide means, wherein the medium is transported along a transport path and the guide means is positioned such that the guide means does not obstruct any portion of the transport path, wherein the guide means is positioned closer to the discharge means than the contact means;

the transport unit comprises a pair of roll members provided in opposition to each other forming a first nip area;

the discharge unit comprises a pair of roll members provided in opposition to each other forming a second nip area;

wherein a hypothetical line extends between an end point of the first nip area and a starting point of the second nip area; and wherein when the contact means is positioned at the second position, a tip of the contact means crosses over the hypothetical line and is disposed on the same side as the guide means relative to the hypothetical line.

15. The discharge device according to claim 13, wherein the guide member is integral with the housing.

16. The discharge device according to claim 13, wherein the contact member moves in the second direction while the contact member is in contact with the second surface of the medium.

17. The discharge device according to claim 1, wherein a shaft of the contact member and the guide member are provided in opposition to each other across a line connecting an end point of the first nip area and a start point of the second nip area; and a tip of the contact member crossing the line.

18. The discharge device according to claim 1, wherein the first surface has an image formed thereon.

19. The discharge device according to claim 1, wherein the contact member moves in the second direction while the contact member is in contact with the second surface of the medium.

20. The discharge device according to claim 14, wherein a shaft of the contact means and the guide means are provided in opposition to each other across a line connecting an end point of the first nip area and a start point of the second nip area; and a tip of the contact means crossing the line.

21. The discharge device according to claim 14, wherein the first surface has an image formed thereon.

22. The discharge device according to claim 14, wherein the contact means moves in the second direction while the contact means is in contact with the second surface of the medium.

23. The discharge device according to claim 13, wherein a shaft of the contact member and the guide member are provided in opposition to each other across a line connecting an end point of the first nip area and a start point of the second nip area; and a tip of the contact member crossing the line.

* * * * *